US005180301A

United States Patent [19]

Gross

[11] Patent Number: 5,180,301

[45] Date of Patent: Jan. 19, 1993

[54] AIR-OIL BURNER

[76] Inventor: Daniel Gross, 7 Sparrow La., Levittown, Long Island, N.Y. 11756

[21] Appl. No.: 700,361

[22] Filed: Aug. 21, 1991

[51] Int. Cl.[5] ..... F23L 7/00

[52] U.S. Cl. ..... 431/116

[58] Field of Search ..... 431/115, 116

[56] References Cited

U.S. PATENT DOCUMENTS

| | | | |
|---|---|---|---|
| 2,813,578 | 11/1957 | Ferguson | 431/115 |
| 3,869,244 | 3/1975 | Von Linde et al. | 431/116 |
| 4,380,429 | 4/1983 | LaHaye et al. | 431/115 |

FOREIGN PATENT DOCUMENTS

| | | | |
|---|---|---|---|
| 14224 | 2/1977 | Japan | 431/115 |
| 1156427 | 6/1969 | United Kingdom | 431/116 |

*Primary Examiner*—Carroll B. Dority
*Attorney, Agent, or Firm*—Mr. Hunter

[57] ABSTRACT

A fuel burner assembly is provided with concentric chambers, the central chamber of which houses the fuel delivery nozzle, the annular chamber surrounding the central chamber comprising an intake and mixing chamber for receiving heated combustion air and ambient fresh air, the annular chamber being ported to pass the mixture of heated and ambient air to the central chamber to mix with the fuel delivered from the nozzle which is heated by the air mixture, the inlet ports to the annular chamber being adjustable as are the ports from the annular chamber to the central chamber, an adjustable iris baffle adjacent the upstream end of the annular chamber controls the stream of primary air delivered to the central chamber.

6 Claims, 1 Drawing Sheet

AIR-OIL BURNER

Figure 1:
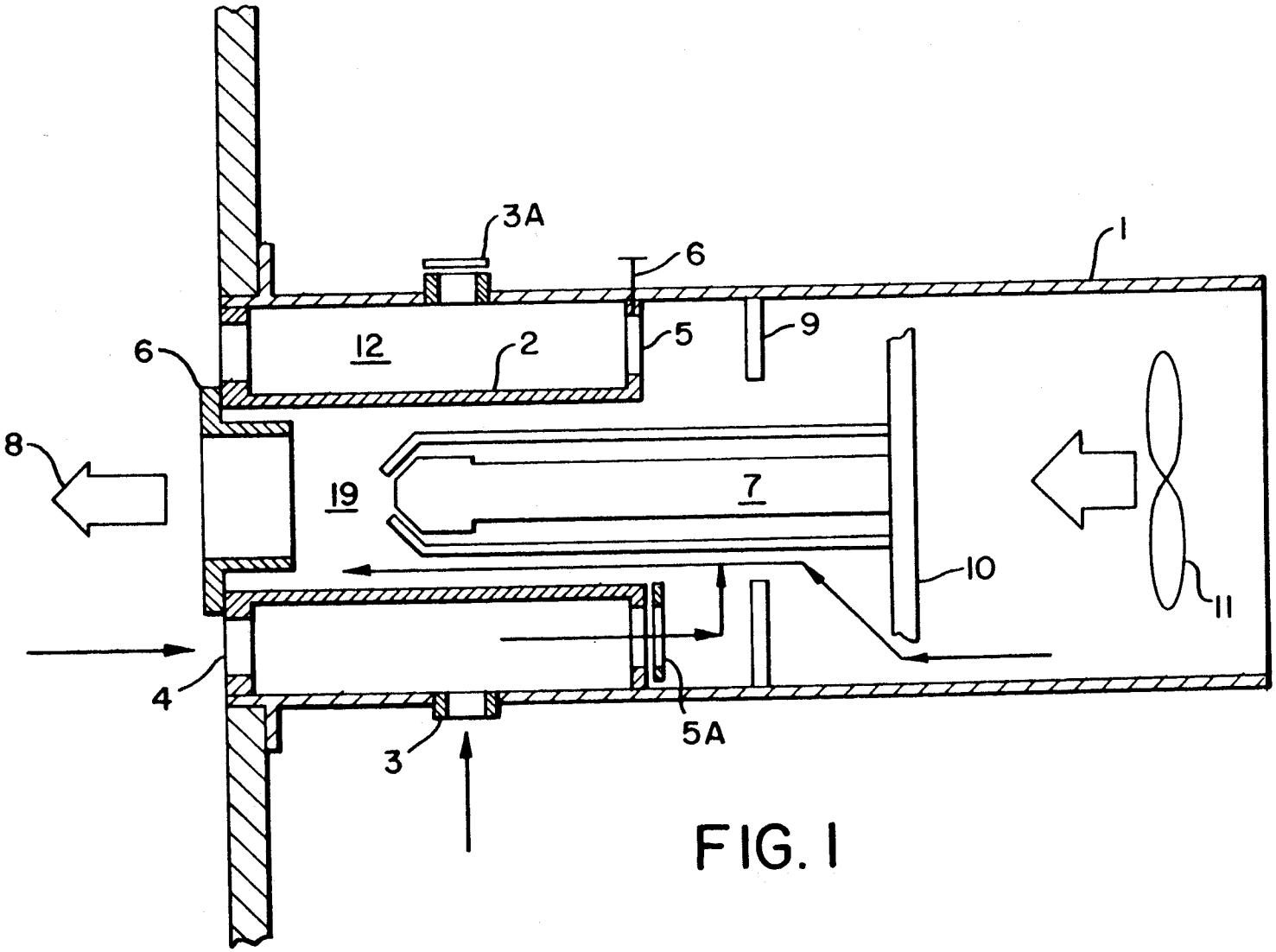

This invention relates to oil burners, particularly of the type which provide for recirculation of combustion air from the combustion chamber of a furnace.

Prior art apparatus and methods for mixing air in fuel burners are disclosed, for example, in Ferguson U.S. Pat. No. 2,813,578; Von Linde et al. U.S. Pat. No. 3,869,244; LaHaye et al U.S. Pat. No. 4,380,429 and British patent specification No. 1,156,427 published Jun. 25, 1969 and Japanese Patent 52-14224 issued Mar. 2, 1977.

FIG. 1 is a diagrammatic longitudinal cross sectional view of the air and oil mixer assembly of the invention.

One of the basic features of the present invention is the existence of parts (3), (4) and (4A) to admit two types of secondary air into the flame chamber (7) and mix the secondary airs and the burner primary air (10).

The admission of secondary air as such (3), (4) and (4A) into the combustion chamber is not unique to my design. What is unique is the physical structure and geometry of a system of openings that controls this air and makes it possible to fine tune its quantity in order to promote better combustion.

The Meenan nozzle shown in illustration marked FIG. 2 exhibits ports to admit re-circulating secondary air from combustion chamber pointed by arrow. This nozzle assembly had a number of problems such as excess carbon monoxide (CO) formation, poorly heated combustion air, (the dough-nut baffle was a later addition to minimize this problem), also soot built-up and poor draft.

My invention will circumvent this problem by making the following changes:

a) Notice that the secondary air in the Meenan burner is isolated from the primary air. This does not promote a stabilized air mixture of ($O_2$) oxygen and fuel (C & H). My design allows the re-circulated heated combustion secondary air (4) and secondary fresh air (3) through (4A) to mix with the primary fresh air (10). This is shown in my invention with component (8) called an "adjustable baffle for primary air control." It is in this area that primary and secondary airs mix, a process that is not allowed to take place in other designs. My design thus has another means of controlling the fresh secondary air through openings (3) and adjustment band (3A). In summary, the existence of adjustable openings no. (3) and no. (4A) allows the optimal mixing of primary air (11) and secondary airs through (3) and (4) and (4A) with fuel. This eliminates the unvented products of combustion such as carbon monoxide and smoke. This superior mixture results in a cleaner and higher temperature flame.

The apparatus shown in FIG. 1, which has just been discussed with reference to the various areas of air mixture, etc. comprises an outer casing 1 and inner annular wall 2 which forms with the outer casing annular chamber 12.

The central chamber 19 formed by wall 2 houses the fuel delivery nozzle 7. Primary air delivery is provided at the upstream end of the device via fan 11. The path of the stream of air from the fan is controlled by an adjustable baffle 9 upstream of the annular chamber 12 and the central chamber 19.

The annular chamber 12 provides ports 4 at the downstream end and ports 5 at the upstream end. The ports at the upstream end may be adjustable via air veins 6 or by any similar means such as adjustment rings 5A. The ports 3 communicating ambient air into the annular chamber 12 are also adjustable via adjustment rings 3A.

The inventive concept includes:

1) Means of allowing primary and secondary airs to mix near primary opening (5) to insure a more positive air mix.

2) Total secondary air has two components:

a) Chamber (19) recirculating heated secondary air from the combustion chamber 8 which supplies heat to oil spray to accelerate vaporization.

b) Fresh secondary air entering ports (3) to supply fresh oxygen to the recirculating partially oxygen depleted combustion chamber secondary air.

3) This design allows the mechanic in the field to fine tune the device with simple and effective adjustments of openings (3), (5) and (9).

4) This results in a higher temperature and cleaner flame which is environmentally beneficial and will burn the sulphur off and cut out carbon monoxide (CO). This will result in cleaner exhaust and longer lasting clean flues and ancillary equipment and low $NO_x$ content.

5) The recirculation of secondary air from ports (4), (3) and (5) with its fresh air component will result in a higher transfer efficiency and more stabilized combustion. The BTU per pound of fuel will come closer to its theoretical limit of about 140,000 BTU's per pound of #2 fuel because of the influx of fresh secondary oxygen through port (3) changing the residual $CO_2$. The mechanic will be able to check the results of air intake adjustment by measuring the $CO_2$ dreft, temperature and smoke. This will insure a low CO content and Bachrach #0.1 smoke level, low $NO_x$ content, a high $CO_2$ content, low excess air and no unburned hydrocarbon.

6) The following components are unique to this design.

a) Adjustable ring (3A) for optional secondary fresh air.

b) Adjustable iris type radial baffle (9) for primary air.

c) Adjustable air veins (6) for adjustment ring (5A) over openings (5) for controlling recirculating chamber combustion air.

d) The warm secondary chamber air is not admitted directly into the combustion area but is directed to flow between the inner and outer cylinders (1) and (2). This permits the warm recirculating combustion chamber air to heat up the oxygenated vaporized fuel going through the cylinders while at the same time keeping a constant temperature of air while mixing with the fresh secondary air entering through ports (3) and the primary air from the fan (11).

e) In conjunction with these controls is a removable static disc (10) on nozzle (7) upstream of baffle (9) to give better volumatic-pressure control to primary air and secondary air from the combustion chamber and through ports (3) and (5) to combustion chamber (8).

f) All basic component parts herein described are of heat resistive metals of the finest quality so as to get the best and most stabilized results.

I claim:

1. In a fuel burner assembly comprising an outer wall, an inner wall concentric with said outer wall, said inner wall defining a central chamber, a fuel delivery nozzle in said central chamber, said outer and inner walls defining an annular chamber surrounding said central chamber, primary air supply means upstream of said central chamber for supplying a stream of air to said central chamber, means for supporting the downstream end of said inner and outer walls of said assembly to a combustion chamber, said downstream end of said central chamber communicating with said combustion chamber, the improvement comprising:

said annular chamber extending in the upstream direction from its downstream end past the downstream end of said nozzle and terminating at its upstream end downstream of said primary air supply means;

first port means at said downstream end of said annular chamber for receiving heated combustion air from the combustion chamber into said annular chamber;

second port means in said outer wall communicating with said annular chamber for receiving secondary air from outside of said annular chamber into said annular chamber;

third port means at said upstream end of said annular chamber for passing the mixed heated combustion air and secondary air to said central chamber;

baffle means upstream of said third port means for controlling the stream of air from said primary air supply means to said first chamber and for directing the mixed heated combustion air and secondary air into the stream of air from said primary air supply around said nozzle;

said central chamber comprising channel means for supplying the mixed heated combustion air and secondary air from said annular chamber along with said stream of air from said primary air supply means to the combustion chamber.

2. The improvement of claim 1 including means for adjusting the opening of said second port means.

3. The improvement of claim 1 including means for adjusting the opening of said third port means.

4. The improvement of claim 1 wherein said baffle means comprises an annulus about said nozzle and including means for adjusting the opening of said annulus.

5. The improvement of claim 2 including means for adjusting the opening of said third port means.

6. The improvement of claim 5 wherein said baffle means comprises an annulus about said nozzle and including means for adjusting the opening of said annulus.

* * * * *